US006578572B2

(12) United States Patent
Tischer et al.

(10) Patent No.: US 6,578,572 B2
(45) **Date of Patent: *Jun. 17, 2003**

(54) FIREFIGHTING HOOD AND FACE MASK ASSEMBLY

(75) Inventors: Michael Scott Tischer, 101 Lakeview Ct., Tecumseh, OK (US) 74873; Rick Allen Austin, 11521 N. Kickapoo, Shawnee, OK (US) 74804; Jerry Yort, 8216 NW. 69th St., Oklahoma City, OK (US) 73132

(73) Assignees: Jerry Yort; Michael Scott Tischer; Rick Allen Austin

( * ) Notice: Subject to any disclaimer, the term of this patent is extended or adjusted under 35 U.S.C. 154(b) by 0 days.

This patent is subject to a terminal disclaimer.

(21) Appl. No.: 09/992,194

(22) Filed: Nov. 14, 2001

(65) Prior Publication Data

US 2002/0046752 A1 Apr. 25, 2002

Related U.S. Application Data

(62) Division of application No. 09/544,369, filed on Apr. 6, 2000, now Pat. No. 6,328,031, which is a continuation-in-part of application No. 09/389,119, filed on Sep. 2, 1999, which is a continuation of application No. 08/821,099, filed on Mar. 20, 1997, now abandoned.

(51) Int. Cl.[7] ..... A62B 19/00

(52) U.S. Cl. ..... 128/201.25; 128/201.24; 128/206.24; 128/201.29; 128/206.26; 2/424

(58) Field of Search ..... 128/201.15, 201.24, 128/201.29, 202.24, 202.27, 205.25, 206.26, 206.14, 206.24, 207.11; 2/424

(56) References Cited

U.S. PATENT DOCUMENTS

| | | | | | |
|---|---|---|---|---|---|
| 2,414,405 | A | | 1/1947 | Bierman et al. | |
| 2,529,106 | A | | 11/1950 | Schauweker | |
| 2,587,958 | A | | 3/1952 | Belloni | |
| 2,881,758 | A | | 4/1959 | Motsinger | |
| 2,935,985 | A | | 5/1960 | Andrews et al. | |
| 3,672,365 | A | | 6/1972 | Morgan | |
| 3,943,571 | A | * | 3/1976 | Boatman | 128/201.23 |
| 4,174,710 | A | * | 11/1979 | Pampuch | 128/206.24 |
| H863 | H | | 1/1991 | Kwoedprpwocz et al. | |
| H1023 | H | | 3/1992 | Wiseman, Sr. | |
| 5,181,506 | A | * | 1/1993 | Tardiff et al. | 128/201.22 |
| 5,219,368 | A | * | 6/1993 | Page | 128/201.24 |
| 5,245,993 | A | | 9/1993 | McGrady et al. | |
| H1360 | H | | 10/1994 | Grove et al. | |
| 5,431,156 | A | * | 7/1995 | Sundstrom | 128/201.23 |
| 5,575,278 | A | | 11/1996 | Bonhomme et al. | |
| 5,628,065 | A | | 5/1997 | Austin | |
| 5,653,225 | A | | 8/1997 | Schegerin | |
| 5,687,713 | A | * | 11/1997 | Bahr et al. | 128/201.28 |
| 6,006,360 | A | * | 12/1999 | Reed | 2/202 |
| 6,176,239 | B1 | | 1/2001 | Grove et al. | |

* cited by examiner

*Primary Examiner*—Glenn K. Dawson
*Assistant Examiner*—Michael Mendoza
(74) *Attorney, Agent, or Firm*—Dunlap Codding & Rogers

(57) ABSTRACT

An apparatus having a face mask removably attachable to a firefighting hood is provided. The face mask used in cooperation with a breathing apparatus such as a self-contained breathing assembly or a respirator. The face mask has a rim supporting a seal member that operatively sealingly engages the user's face providing a breathing chamber between the user's face and the face mask that is sealed off from the external environment. The firefighting hood has a compliant material enclosing the wearer's head and a support frame surrounding a front opening in the firefighting hood exposing the wearer's face. The firefighting hood matingly engages the face mask such that a perimeter portion of the firefighting hood around the front opening is nested behind the rim of the face mask so as to prevent gaps between the firefighting hood and the face mask. A fastener system attaches the face mask to the firefighting hood to retain the nested arrangement of the perimeter portion of the firefighting hood in an attached position of the face mask to the firefighting hood.

17 Claims, 16 Drawing Sheets

FIREFIGHTING HOOD AND FACE MASK ASSEMBLY

CROSS REFERENCE TO RELATED APPLICATIONS

This application is divisional of U.S. Ser. No. 09/544,369, filed Apr. 6, 2000, now U.S. Pat. No. 6,328,031 which is a continuation-in-part of U.S. Ser. No. 09/389,119, filed Sep. 2, 1999, which is a continuation of U.S. Ser. No. 08/821,099, filed Mar. 20, 1997, now abandoned.

BACKGROUND OF THE INVENTION

1. Field of the Invention

The present invention relates generally to protective head gear for a firefighter, and more particularly, but not by way of limitation, to an improved firefighting hood and face mask assembly.

2. Brief Description of the Related Art

To protect the head, face, and neck areas, a firefighter often wears a firefighting hood in conjunction with other protective equipment such as a face mask and a helmet. Firefighting hoods are constructed of a fire-retardant, thermal barrier material, such as a knitted or woven aramid polymer material. Typically, firefighting hoods are made of two or more layers of such material. This layered arrangement of material protects the firefighter from burns of the skin.

While the helmet protects against head impacts and the firefighting hood protects against burns, the face mask protects the firefighter from breathing hazards such as smoke and noxious fumes. To be protected from all hazards, it is not unusual to wear all these protective devices at once. It is particularly advantageous to wear both the firefighting hood and the face mask simultaneously.

The face mask can be part of a self-contained breathing apparatus (SCBA) which supplies breathing air from a storage container, or the face mask can include a respirator which filters out harmful particulates from the environment to provide safe breathing air.

Although these devices protect against the harsh environment of a fire scene, they also can be overly restrictive and cumbersome when not needed. As a result, the firefighter will often don, then doff, then don again one or more of the devices during the course of firefighting. The firefighter will usually only be wearing a helmet when arriving at the scene of a fire. After quickly assessing the scene, the firefighter may don the firefighting hood and/or the face mask if he must closely approach the fire or is he must enter a burning structure in the course of the firefighting or rescue operation. To don both the hood and the face mask, the firefighter first removes his helmet and then pulls the firefighting hood downward around his neck to expose his head. Next, the firefighter dons the face mask which has a plurality of straps that are trained around his head for sealingly supporting the face mask against his face. The firefighting hood is then pulled upward over the firefighter's head and overlaps the face mask. Finally, the firefighting helmet is redonned over the face mask and the firefighting hood.

This arrangement and method has several disadvantages. First, the amount of time necessary to don the firefighting hood and the face mask as separate components is time consuming. Second, the straps of the face mask can be uncomfortable after extended periods of time in a high heat environment. Third, due to the fact that the hood is not mechanically connected to the face mask, when the firefighter pulls the firefighting hood back over the face mask, gaps tend to develop between the firefighting hood and the face mask leaving portions of the firefighter's skin susceptible to burns. All these disadvantages are magnified by the urgency associated with the activity of a fire scene where time is of the essence.

Accordingly, a need exists for a firefighting hood and face mask assembly which simplifies and speeds the donning of the firefighting hood and the face mask and which reduces the risk of injury to the firefighter while permitting the hood to be quickly and easily detailed from the face mask to facilitate cleaning and/or replacement of the hood. It is to such an assembly that the present invention is directed.

SUMMARY OF THE INVENTION

The present invention is directed to an apparatus for protecting an individual from elements associated with a firefighting site. The apparatus includes a face mask and a firefighting hood. The face mask includes an annular rim, a seal member secured to the rim and adapted for sealing engagement with the individual's face, and a face plate extending across the rim and cooperating with the rim and the seal member to form a breathing chamber when the seal member is in sealing engagement with the individual's face. The seal member is configured so as to define an annular recess between a portion of the seal member and the rear side of the rim.

The firefighting hood is constructed of a fire resistant material and configured to be extendible over the head of the individual. The hood has a face opening for exposing the individual's face to the breathing chamber of the face mask. The face opening is defined by an annular edge of the hood. A support frame is secured adjacent the annular edge to increase the rigidity of the annular edge of the hood. The annular edge of the hood and the support frame are disposed in the annular recess of the face mask.

The hood is detachably connected face mask so as to secure the annular edge of the hood in the annular recess of the face mask and thereby prevent direct exposure of the individual's head to the high heat environment associated with a firefighting site.

The objects, features and advantages of the present invention will become apparent from the following detailed description when read in conjunction with the accompanying drawings and appended claims.

DETAILED DESCRIPTION OF THE INVENTION

Figure 1:
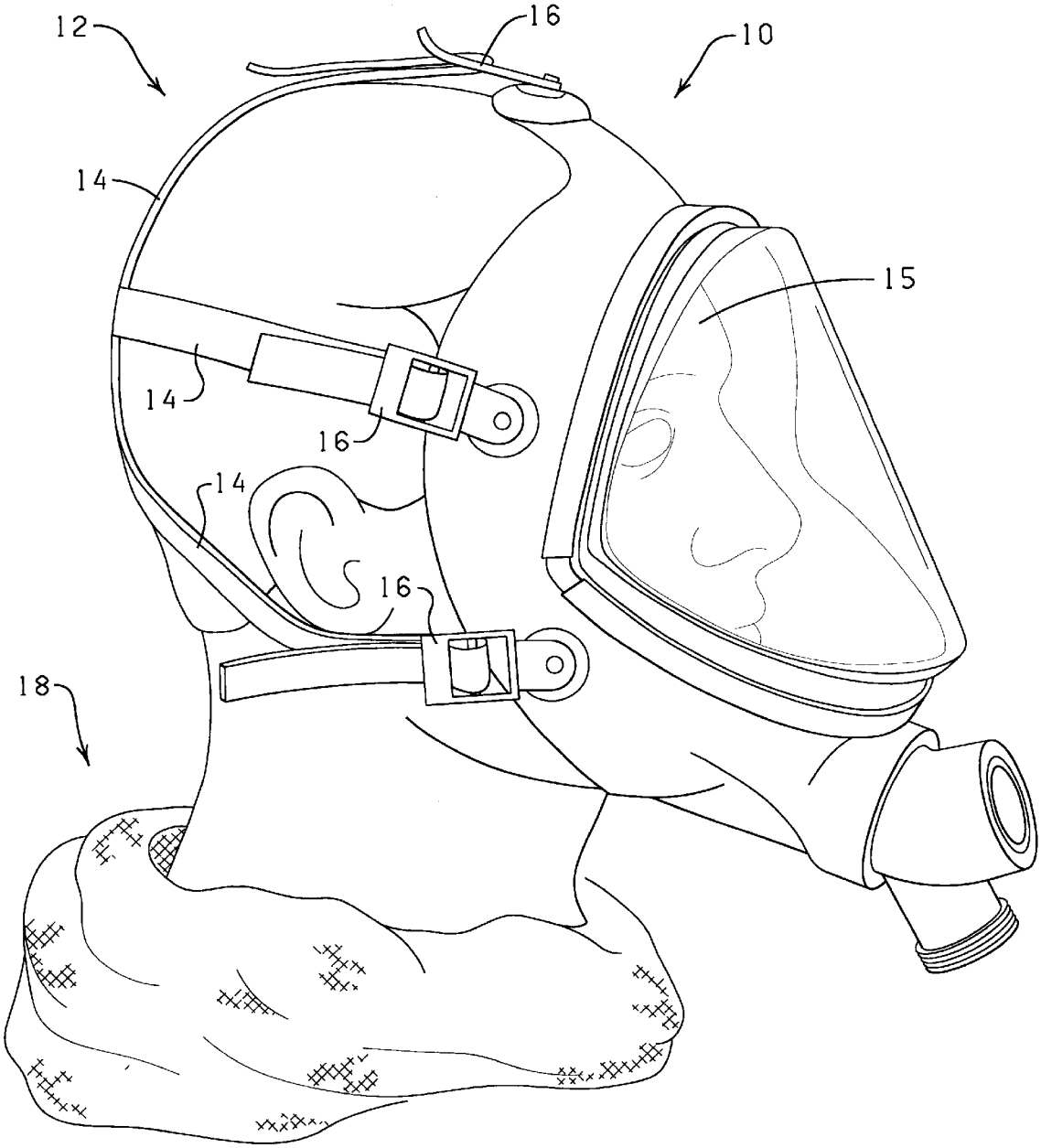
FIG. 1 PRIOR ART
FIG. 1 is a perspective view of a prior art face mask on a firefighter's head with a prior art firefighting hood pulled down around the firefighter's neck.
Figure 2:
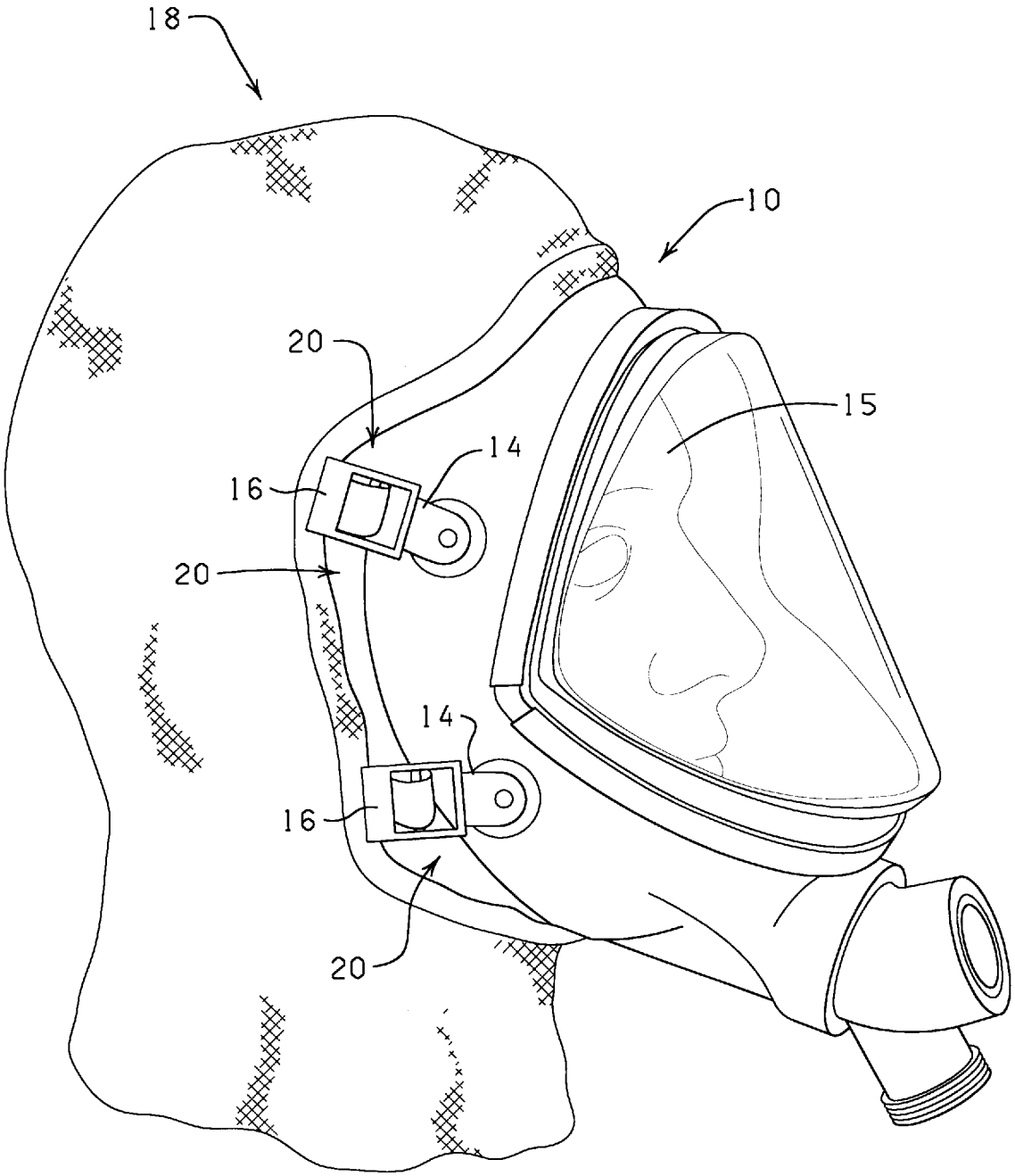
FIG. 2 PRIOR ART
FIG. 2 is a perspective view of the prior art firefighting hood of FIG. 1 pulled over the periphery of the prior art face mask.

Referring now to the drawings, and more particularly to FIGS. 1 and 2, shown is a prior art face mask 10 which includes a harness 12 having a plurality of straps 14 for securing the face mask 10 snugly against a firefighter's face 15. Each of the straps 14 are independently adjusted using adjustable buckles 16. If a firefighting hood 18 is worn in conjunction with the face mask 10, the firefighter typically first pulls the firefighting hood 18 down around his neck as shown in FIG. 1.

With the prior art face mask 10 in place, the firefighting hood 18 is pulled upward to overlappingly engage the face mask 10. As shown in FIG. 2, when the prior art firefighting hood 18 is pulled upward over the firefighter's head, the firefighting hood 18 can catch, such as on the buckles 16, thereby exposing skin between the firefighting hood 18 and the face mask 10. Because time is of the essence, the firefighter may not have the time to thoroughly check to determine whether skin 20 is exposed. Furthermore, because of this overlapping arrangement of the firefighting hood 18 and the face mask 10, the subsequent donning of a firefighting helmet (not shown) may likewise shift the prior art firefighting hood 18 so as to create a gap between the firefighting hood 18 and the face mask 10.

Figure 3:
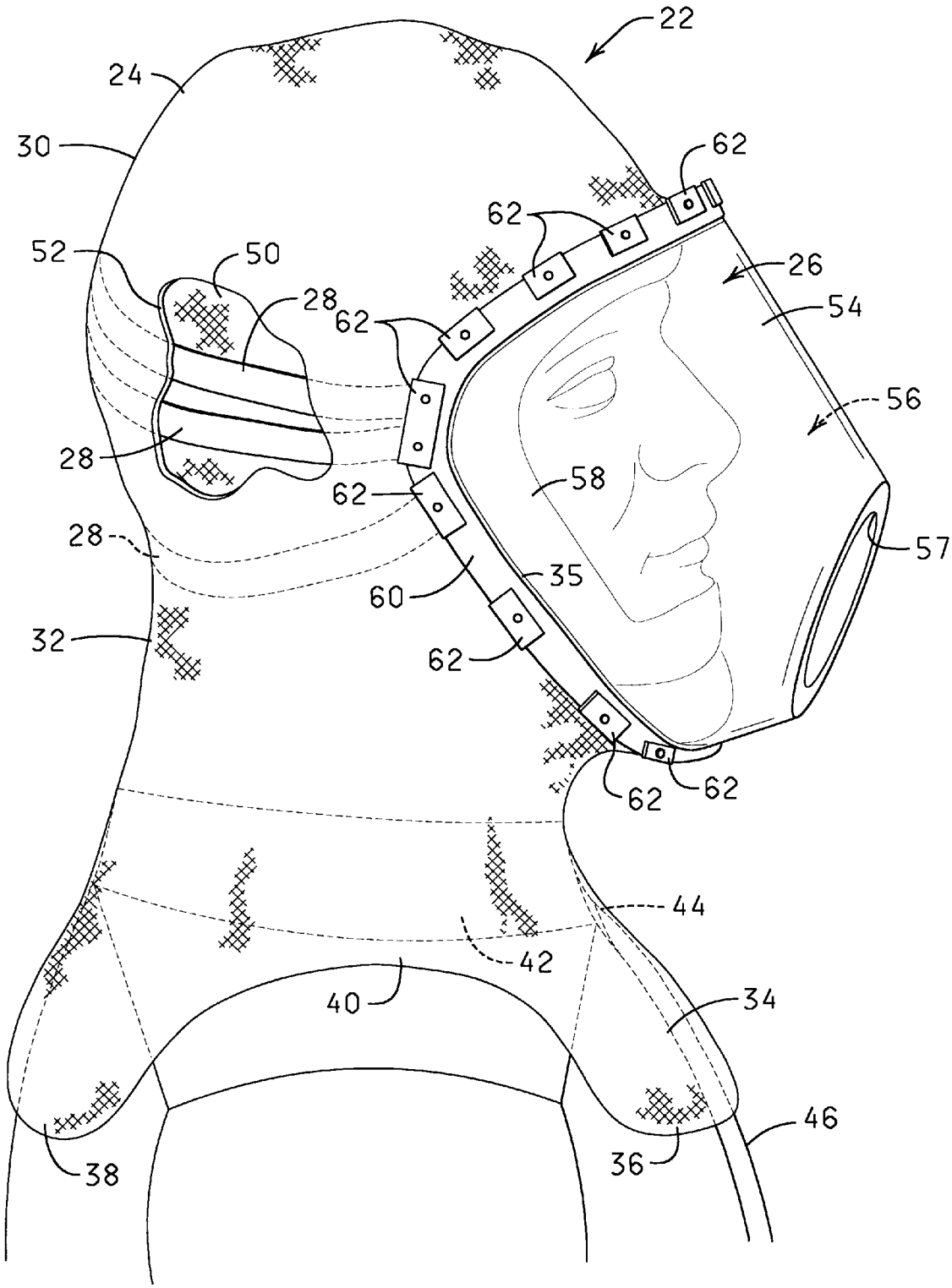
FIG. 3 is a partially cut-away, perspective view of a firefighting hood and face mask assembly constructed in accordance with the present invention.

FIG. 3 illustrates a firefighting hood and face mask assembly 22 constructed in accordance with the present invention. The firefighting hood and face mask assembly 22 includes a firefighting hood 24, a face mask 26, and at least one elastic strap 28. The firefighting hood 24 is shaped to enclose the firefighter's head, and thus includes a head portion 30 shaped to cover the forehead, ears and chin of the firefighter, a neck portion 32 shaped to cover the neck of the firefighter, and an optional bib portion 34. The head portion 30 of the firefighting hood 24 has a front opening 35 for exposing the firefighter's eyes, nose and mouth portions of his face. The bib portion 34 includes a front downwardly extending flap 36, a rear downwardly extending flap 38, and a pair of side flanges 40 which are shorter than the front and rear flaps 36, 38. Thus, the bib portion 34 is shaped and sized to completely cover a collar 42 and to cover an upper portion of a closure 44 of a firefighter's jacket 46, to prevent an egress of fluids and embers between the firefighter's neck and the collar 42 of the firefighter's jacket 46. The shorter side flanges 40 allow for fitting the bib portion 34 over the firefighter's shoulders.

The head portion 30 can be made of inner and outer layers 50, 52 of a knitted or woven heat and flame resistant aramid material. Preferably, the entire firefighting hood 24 is made of a flame and heat resistant knit material. Examples of heat and flame resistant knitted or woven materials for use with the present invention include an aramid polymer material such as Nomex®, a polybenzamidazole ("PBI") fiber, an aramid fiber such as Keviar®, or a combination or blend of any of these or similar materials.

The face mask 26 includes a clear plastic face plate 54 concavely shaped to provide a breathing chamber 56 between the firefighter's face and the face plate 54, and having a channel 57 for providing fluid communication between the interior breathing chamber 56 of the face mask 26 and a breathing apparatus (not shown). The breathing apparatus can be a self-contained breathing apparatus or a respirator, or a combination of both. A cushioned seal member 58 is mounted to the face mask 26 adjacent the front opening 35 and is conformable to sealingly abut against the firefighter's face.

Figure 4:
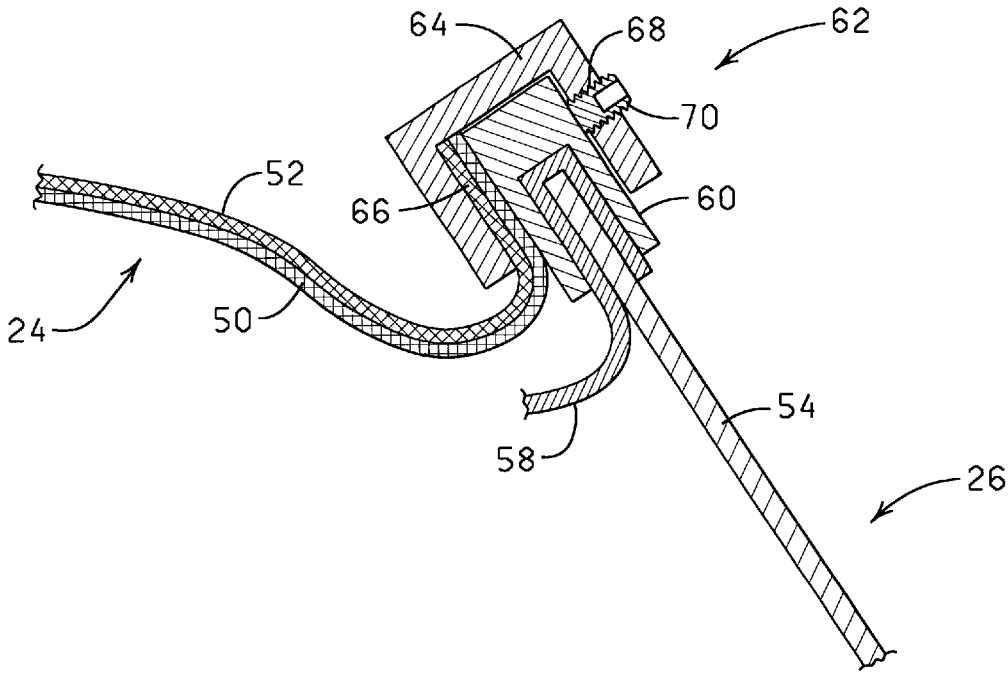
FIG. 4 is a diagrammatical cross-sectional view of a fastener system for use with an embodiment of the present invention to join the face mask and the firefighting hood.

The face mask 26 also includes a rim 60 extending around a perimeter of the face mask 26. As will be described below, the rim 60 provides for an attachment of the seal member 58, the face plate 54, and the head portion 30 of the firefighting hood 24, all together into a sealed, integral assembly. As shown in FIG. 4, for example, the rim 60 clamps and retains both the seal member 58 and the face plate 54.

Returning to FIG. 3, it will be noted that the rim 60 is joined to the firefighting hood 24 by a fastener system having a plurality of fasteners 62 along a perimeter of the front opening 35 of the firefighting hood 24. The fasteners 62 cooperatively provide for a contiguous attachment of the rim 60 of the face mask 26 to the firefighting hood 24 such that no gaps exist between the firefighting hood 24 and the face mask 26. The fasteners 62 are sufficiently robust so as to withstand tensile forces tending to separate the firefighting hood 24 from the face mask 26, especially during the time the firefighter dons and doffs the firefighting hood and face mask assembly 22 as an integral unit.

As shown in FIG. 4, the fastener 62 has a releaseable clamp 64 with a cross-sectional U-shape forming a groove 66. The rim 60 of the face mask 26 and the two layers of the firefighting hood material 50, 52 are receivingly disposed within the groove 66. The clamp 64 further includes a threaded hole 68 extending through the side of the clamp 64 such that a threaded member 70 can be threadingly advanced through the side of the clamp 64 and into pressing engagement against the rim 60 to clamp the firefighting hood 24 within the groove 66 of the clamp 64. Reversing the advancement of the threaded member 70 allows for detachment of the face mask 26 from the firefighting hood 24.

Returning to FIG. 3, the firefighting hood and face mask assembly 22 also includes a retainer to urge the face mask 26 sealingly against the firefighter's face, such as the plurality of the elastic straps 28 attached to selected fasteners 62 and extending around the firefighter's head. The straps 28 are preferably disposed between the inner and outer material layers 50, 52 of the firefighting hood 24, and the straps 28 may also be stitched to the material layers 50, 52 of the firefighting hood 24 to maintain them at a desired position within the head portion 30 of the firefighting hood 24.

Alternatively, the retainer can be provided by elastic yarn or thread woven into the material of the firefighting hood 24, thereby giving the entire firefighting hood 24 a characteristic resilience to facilitate urging the face mask 26 in sealing engagement against the firefighter's face. Adjustable straps, pull-threads, adjustment flaps, or the like, can be used in place of the elastic straps 28 or the elastic weave. It is also within the scope of the invention to size the head portion 30 of the firefighting hood 24 such that it fits tightly around the wearer's head, thereby urging the face mask 26 against the wearer's face. Furthermore, it is within the scope of the invention to use the original harness system of the face mask 26 (an example of which is shown in FIG. 1) as the retainer, attaching the rim 60 of the face mask 26 to the head portion 30 of the firefighting hood 24 by one of the fastener systems described herein, and disposing the head portion 30 of the firefighting hood 24 over the harness system of the face mask 26.

Figure 5:
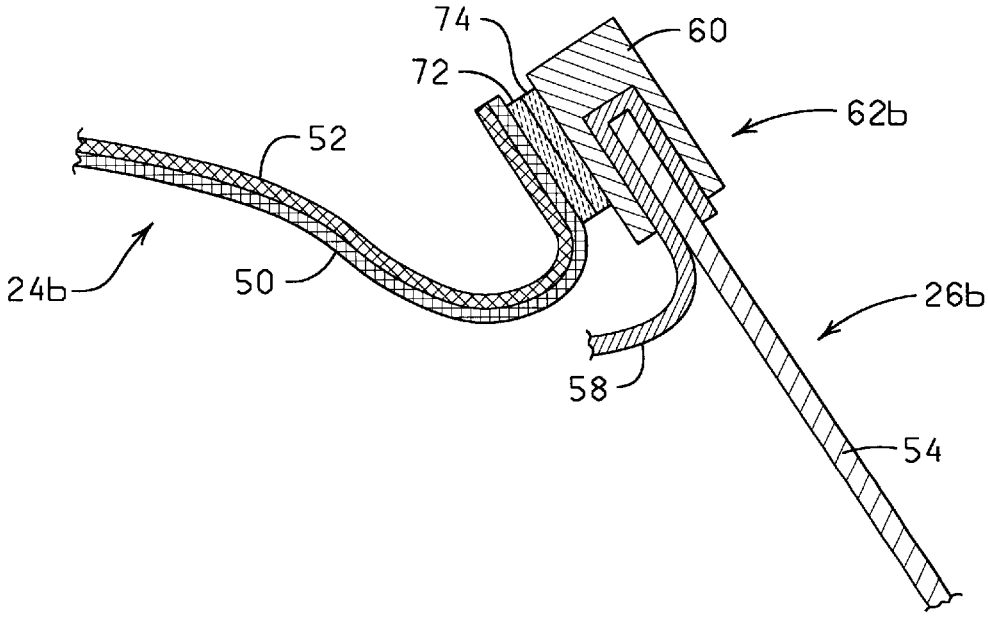
FIGS. 5–11 are diagrammatical cross-sectional views of alternate fastener assemblies of the present invention.

As shown in FIG. 5, an alternate fastener system 62*b* of the present invention provides patches of hook and pile material 72, 74 to releaseably attach a face mask 26*b* to a firefighting hood 24*b*. A patch of hook material 72 is stitched to the two layers of firefighting hood material 50, 52, so as to be matingly engageable with a corresponding patch of pile material 74 that is bonded to the rim 60 of the face mask 26*b*. It will be noted that the arrangement of the hook material 72 and the pile material 74 can be reversed with respect to the firefighting hood 24*b* and the face mask 26*b* in an equivalent alternative.

Figure 6:
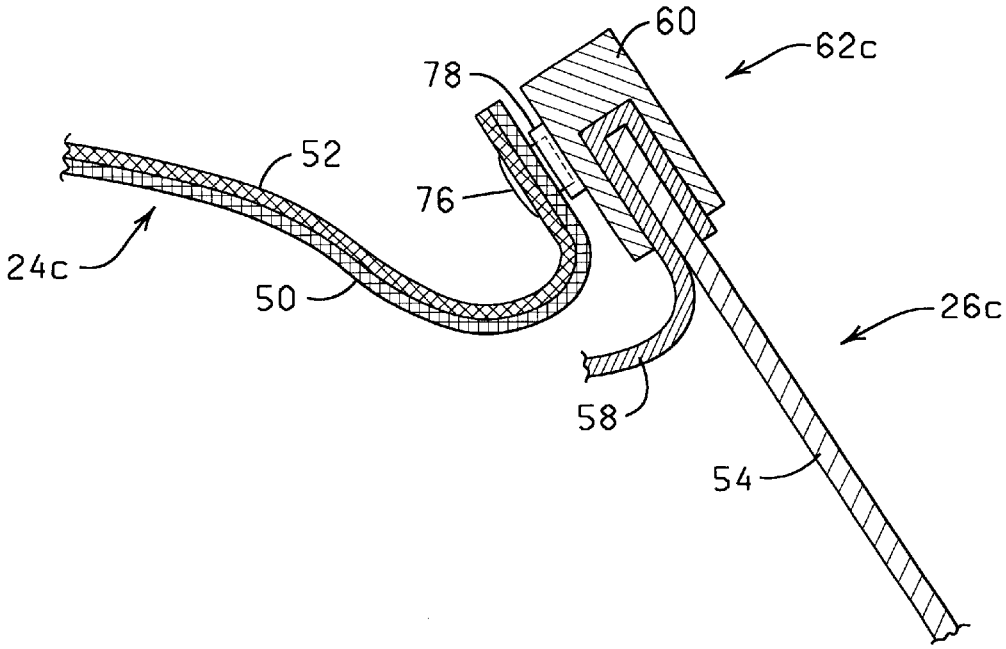

As shown in FIG. 6, another fastener system 62*c* of the present invention provides a male and female snap 76, 78 attaching a face mask 26*c* to a firefighting hood 24*c*. The male snap 76 is crimped, or otherwise fastened, to the two layers of firefighting hood material 50 and 52 so as to be matingly engageable with the corresponding female snap 78 which is bonded to the rim 60 of the face mask 26*c*. It will be noted that the arrangement of the male snap 76 and the female snap 78 can be reversed with respect to the firefighting hood 24*c* and the face mask 26*c* in an equivalent alternative.

Figure 7:
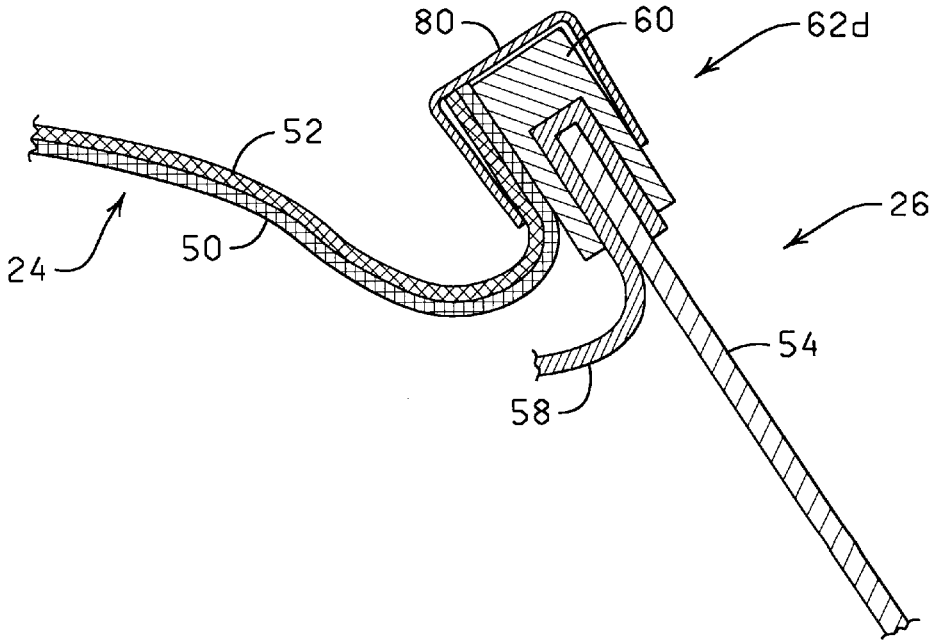

FIG. 7 shows another fastener system 62*d* of the present invention which includes a spring-steel clamp 80 that spans the rim 60 and clamps the firefighting hood 24 to the rim 60 in a manner similar to the clamp 64 of FIG. 4.

Figure 8:
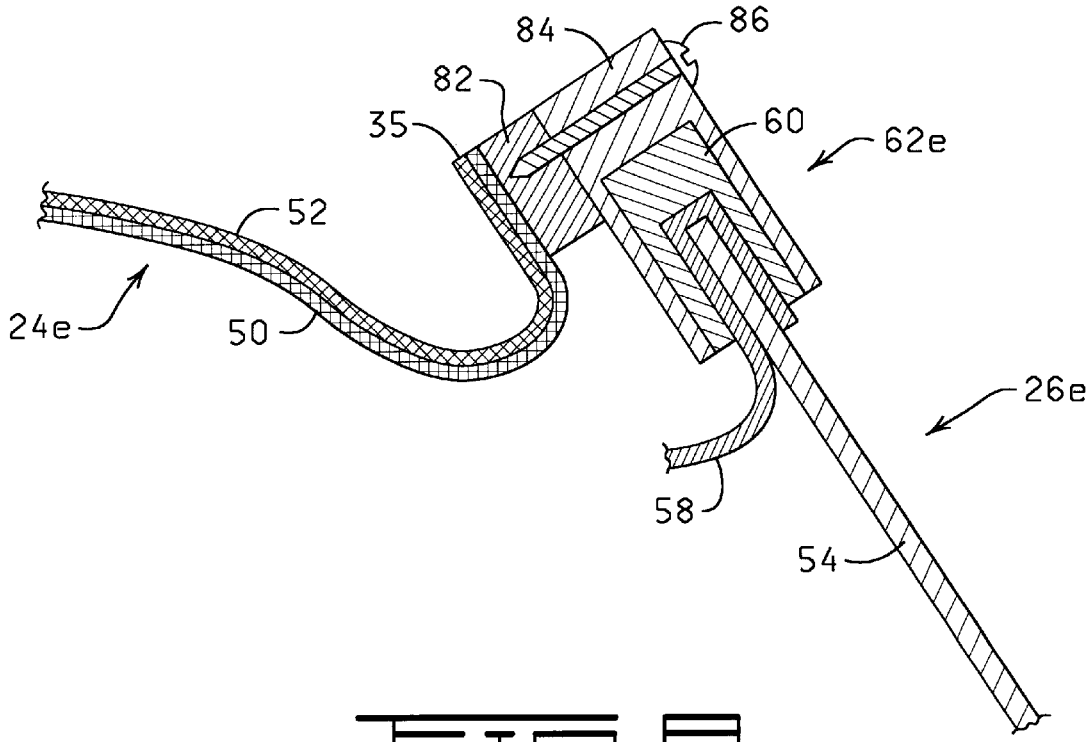

As shown in FIG. 8, another fastener system 62*e* of the present invention provides a frame 82 bonded or stitched around the front opening 35 of a firefighting hood 24*e*. A face mask 26*e* has a frame 84 bonded to the rim 60. The frames 82, 84 are joined together with a fastener 86.

Figure 9:
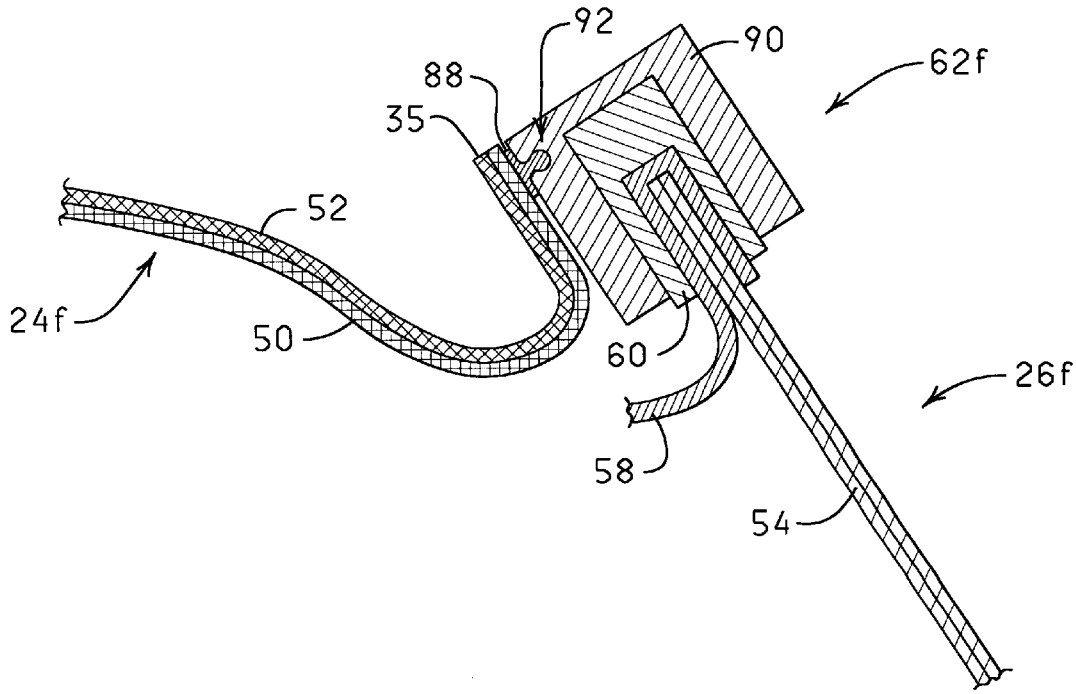

As shown in FIG. 9, another fastener system 62*f* of the present invention provides a frame 88 that is bonded or stitched around the opening 35 of a firefighting hood 24*f*. A face mask 26*f* includes a frame 90 bonded to the rim 60. The frames 88, 90 are joined together using a bead and groove fastener 92. Examples of bead and groove fasteners 92 well suited for use with the present invention include Maxigrip®, Arrowlock®, U-Maxigrip® or Ultraseale® closure systems commercially available from ITW Maxigrip, Somerset, N.J.

Figure 10:
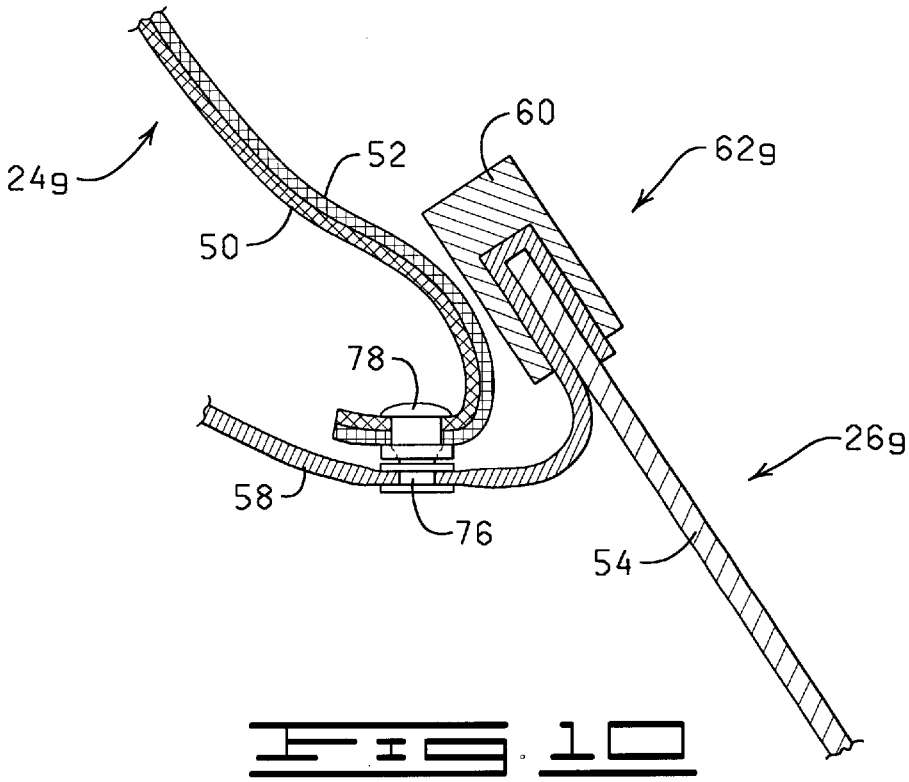

As shown in FIG. 10, in another fastener system 62*g* of the present invention, the female snap 78 is crimped, or otherwise fastened, to the two layers 50, 52 of firefighting hood material so as to be matingly engageable with a corresponding male snap 76 that is crimped, or otherwise fastened, to the seal member 58 of a face mask 26*g*. It will be noted that the arrangement of the female snaps 78 and the male snaps 76 can be reversed with respect to the firefighting hood 24*g* and the face mask 26*g* in an equivalent alternative.

Figure 11:
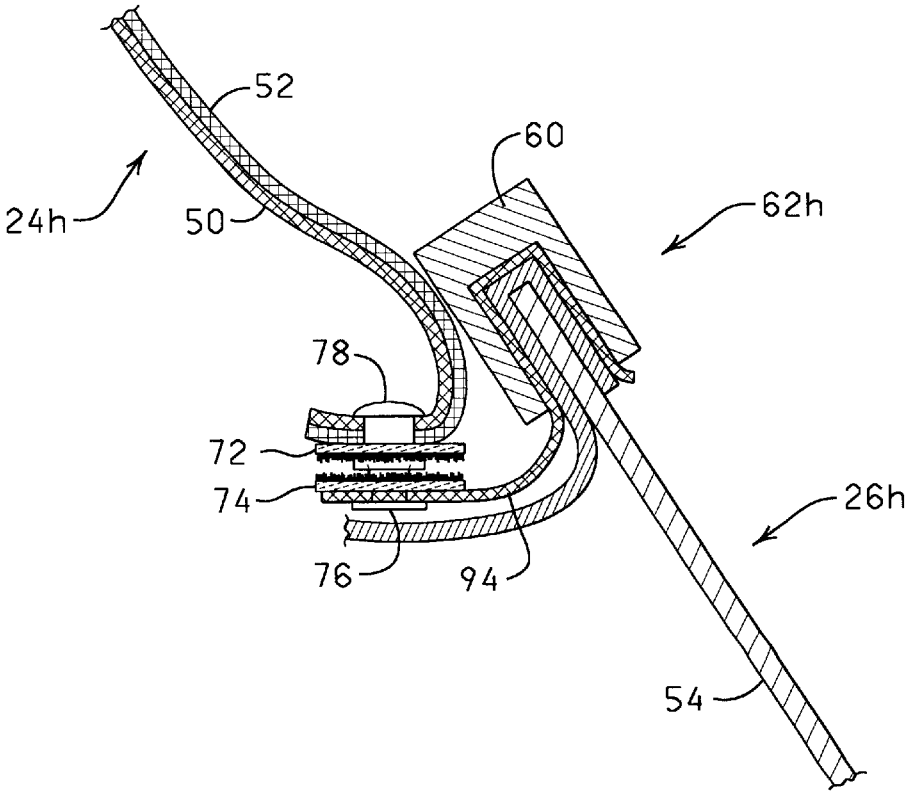

As shown in FIG. 11, in another fastener system 62*h* of the present invention the female snap 78 is crimped, or otherwise fastened, to the two layers 50, 52 of firefighting hood material so as to be matingly engageable with a corresponding male snap 76 that is crimped or otherwise fastened to a harness 94 which is, in turn, clamped between the rim 60 and the face plate 54. Mating patches of hook and pile material 72, 74, respectively, are stitched or bonded to a firefighting hood 24*h* and to the harness 94 to provide additional closure force between the firefighting hood 24*h* and a face mask 26*h*.

Figure 12:
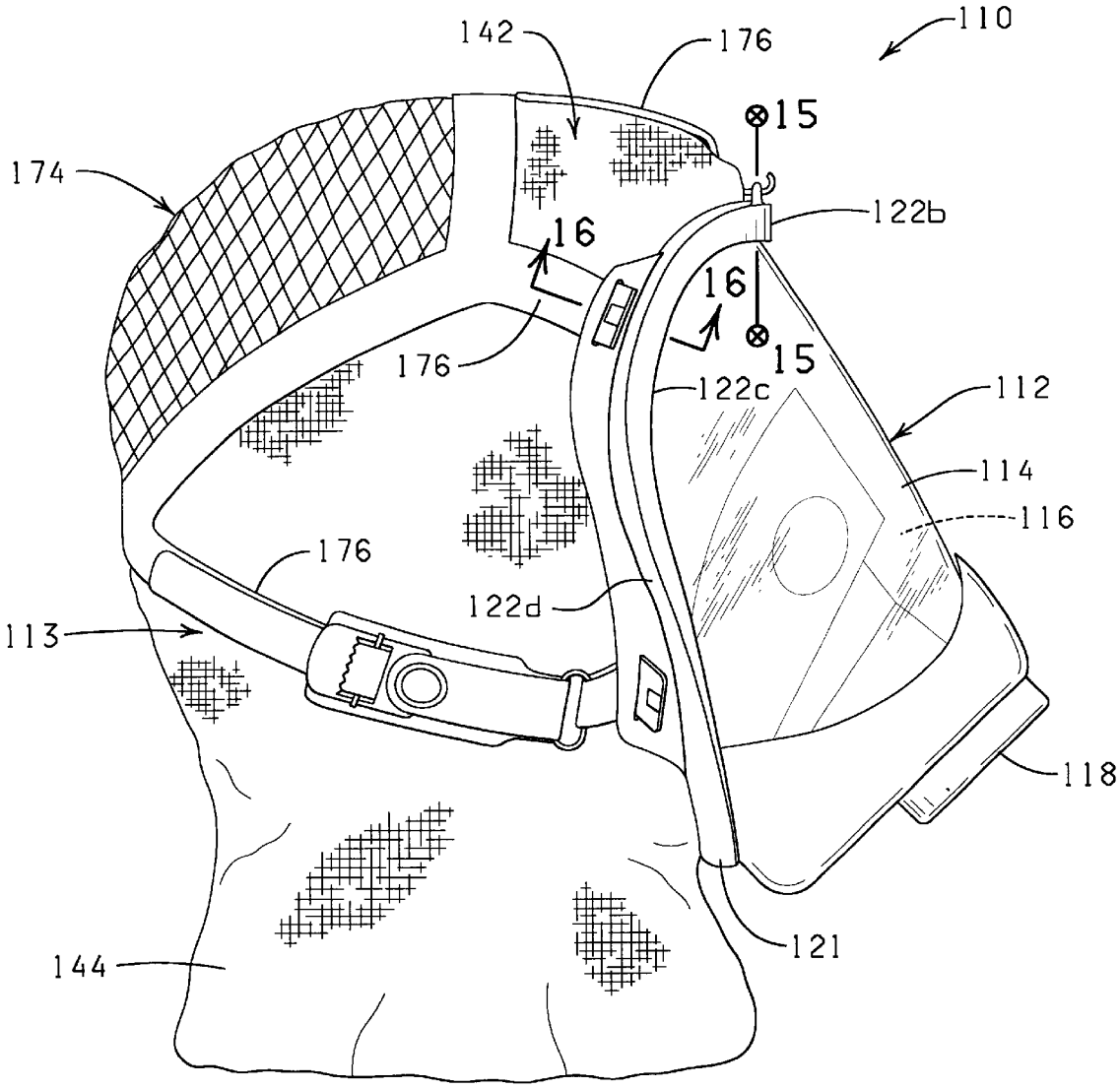
FIG. 12 is a side elevational view of a firefighting hood and face mask assembly constructed in accordance with the present invention.
Figure 13:
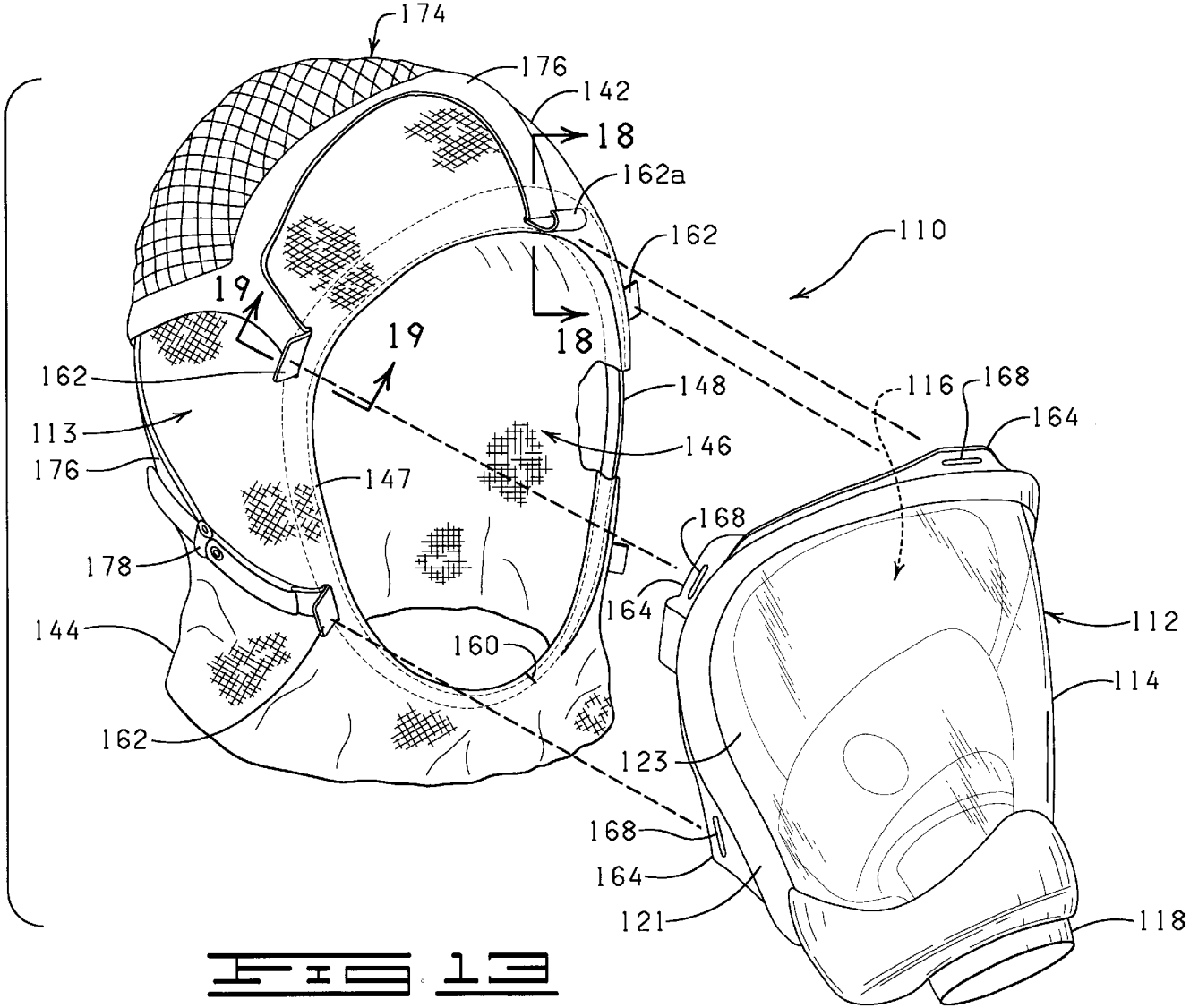
FIG. 13 is an exploded, perspective view of the firefighting hood and face mask assembly of FIG. 12

Referring now to FIGS. 12 and 13, another embodiment of a firefighting hood and face mask assembly 110 constructed in accordance with the present invention is shown. The firefighting hood and face mask assembly 110 includes a face mask 112 and a firefighting hood 113 which is detachably connected to the face mask 112 so as to prevent the formation of gaps or opening between the face mask 112 and the hood 113.

The face mask 112 can be any typical face mask utilized to protect the wearer from smoke inhilation. In general, the face mask 112 includes a clear plastic face plate 114 that is concavely shaped to provide a breathing chamber 116 between the firefighter's face and the face plate 114. The face mask 112 furthermore has a channel 118 for providing fluid communication between the breathing chamber 116 of the face mask 112 and a breathing apparatus (not shown).

The face mask 112 includes a rim 121 extending around a perimeter of the face mask 112. The rim 121 has a front side 122*a*, a rear side 122*b*, an inner side 122*c*, and an outer side 122*d*. A seal member 123 is attached to the inner side 122*c* of the rim 121 such that the seal member 123 extends a distance from the rear side 122*d* of the rim 121. The seal member 123 is configured to conform to the contour of the firefighter's face so as to provide a comfortable engagement of the face mask 112 against the firefighter's face when the firefighting hood and face mask assembly 110 is operatively worn and to seal the breathing chamber 116 from the external environment.

Figure 14:
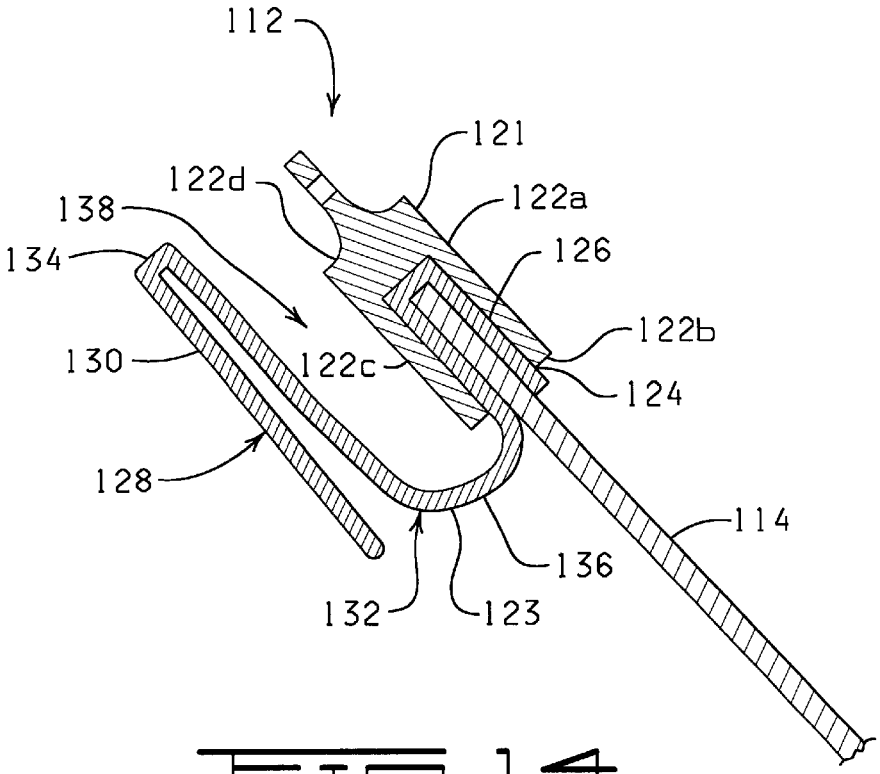
FIG. 14 is a cross-sectional view taken along the line 14—14 of FIG. 13.

As shown in FIG. 14, the rim 121 has a groove 124. In a manner similar to that of the seal member 58 of FIG. 4, the seal member 123 has a first end portion 126 that is clamped within the groove 124 between the rim 121 and the face plate 114. The seal member 123 has a second end portion 128 that operatively sealingly engages the firefighter's face. A medial portion 132 of the seal member 123 provides a biasing force urging the second end portion 128 toward sealing engagement with the firefighter's face. This biasing force is provided by a fold 134 and an arcuate portion 136, both of which are compressed as the second end portion 128 operatively engages the firefighter's face. As best illustrated in FIG. 14, the medial portion 132 of the seal member 123 forms a groove or recess 138 between the second end portion 128 of the seal member 123 and the rear side 122*b* of the rim 121 of the face mask 112.

Returning to FIGS. 12 and 13, it will be appreciated that the firefighting hood 113 is shaped to enclose the firefighter's head. Accordingly, the firefighting hood 113 includes a head portion 142 shaped to cover the firefighter's forehead, ears and chin, and a neck portion 144 shaped to cover the firefighter's neck. As described above, the firefighting hood 113 can also include an optional bib portion (not shown). The head portion 142 can be made of inner and outer layers of a heat and flame resistant knitted or woven aramid material in the manner previously described. Preferably, the entire firefighting hood 113 is made of a flame and heat resistant material such as, but not limited to, Nomex®, a polybenzamidazole ("PBI") fiber, an aramid fiber such as Kevlar®, or a combination or blend of any of these or similar materials.

The head portion 142 of the firefighting hood 113 includes a face opening 146 for exposing the firefighter's nose, eyes, and mouth to the breathing chamber 116 of the face mask 112. The face opening 146 is bordered by an annular edge 147.

As illustrated in FIGS. 4–11, it is desirable that the annular edge of the hood be disposed in the groove formed by the seal member and the rim of the face mask thereby preventing the annular edge from being snagged on an object during the firefighting process. However, when attaching the hood to the face mask in the manner illustrated in FIGS. 3–11, a plurality of closely spaced fasteners are required to be located around the edge of the hood to ensure that the annular edge of the hood remains securely positioned within the groove of the face mask. While utilizing a plurality of closely spaced fasteners can be effective in attaching the hood to the face mask, it becomes inconvenient and time consuming when needing to remove the hood for cleaning or replacement and in turn reattaching the hood to the face mask.

Figure 15:
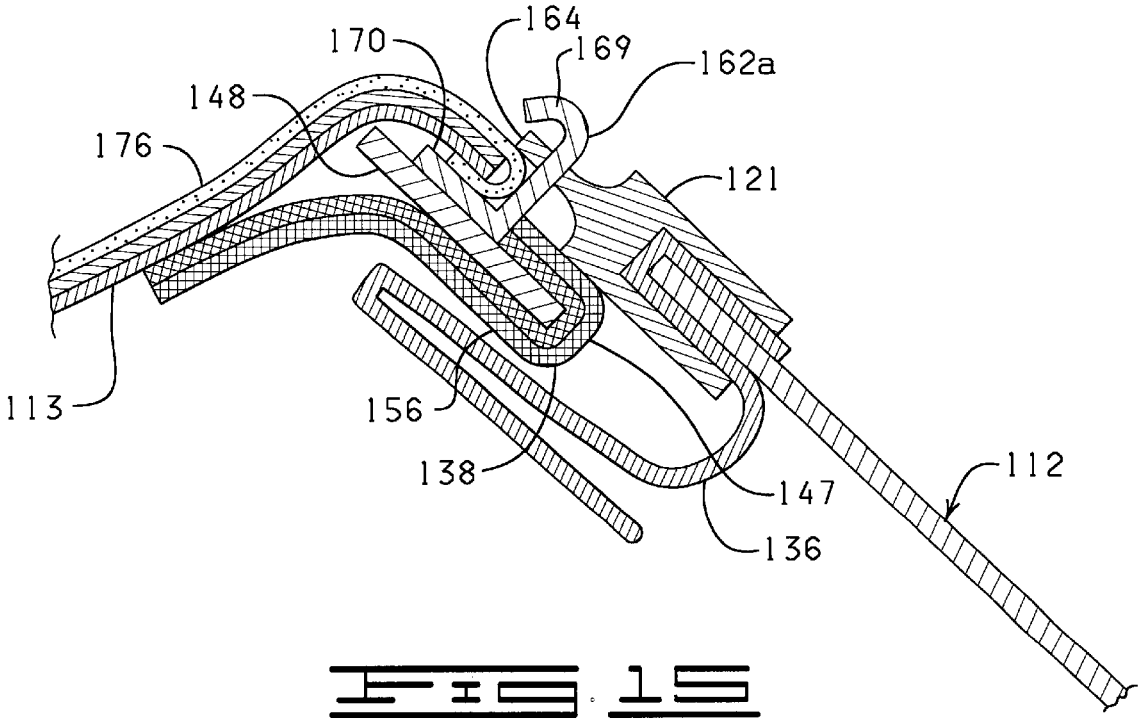
FIG. 15 is a cross-sectional view of the firefighting hood and face mask assembly of the present invention taken along line 15—15 of FIG. 12.
Figure 16:
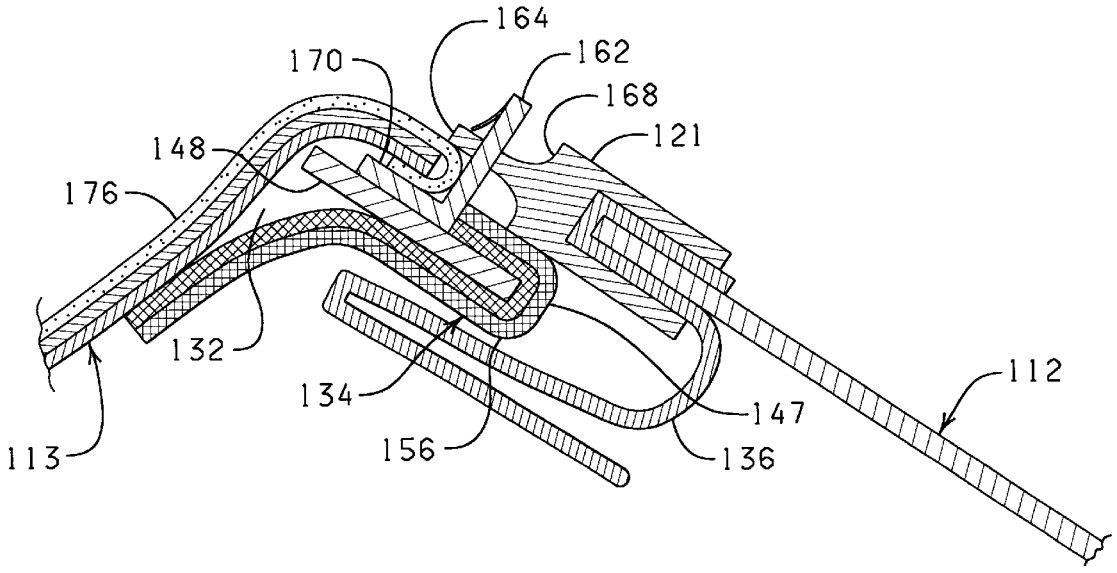
FIG. 16 is a cross-sectional view of the firefighting hood and face mask assembly of the present invention taken along line 16—16 of FIG. 12.

To this end, as illustrated in FIGS. 13, 15, and 16, the hood 113 is provided with a support frame 148. The support frame 148 is secured adjacent the annular edge 147 of the hood 113 to aid in supporting the annular edge 147 of the hood 113 in the groove 138 of the face mask 112 and thus maintain the annular edge 147 in a nested relationship with the rim 121 of the face mask 112 while requiring a minimal number of fasteners.

Figure 17:
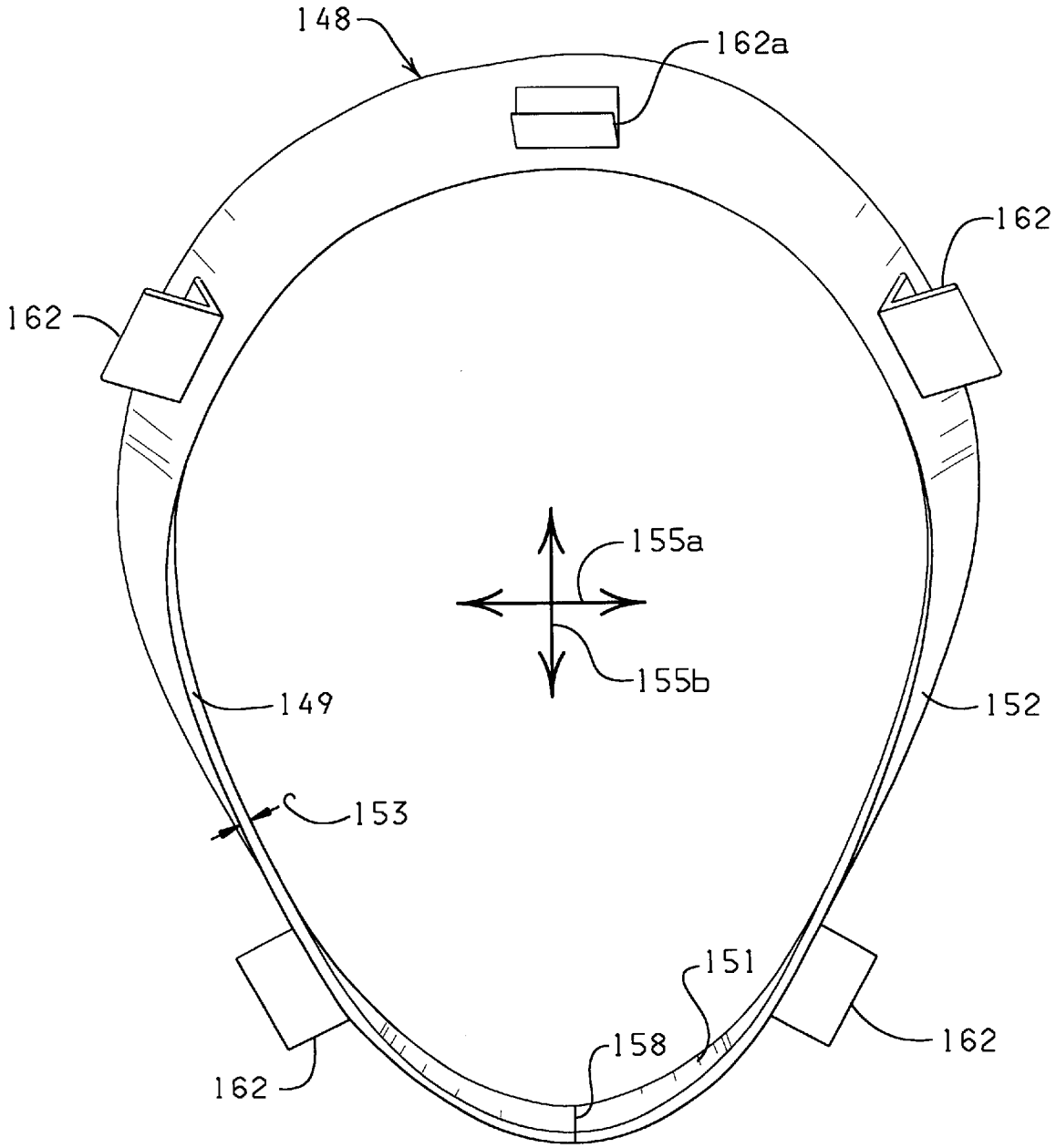
FIG. 17 is a front view of a hood support frame.
Figure 18:
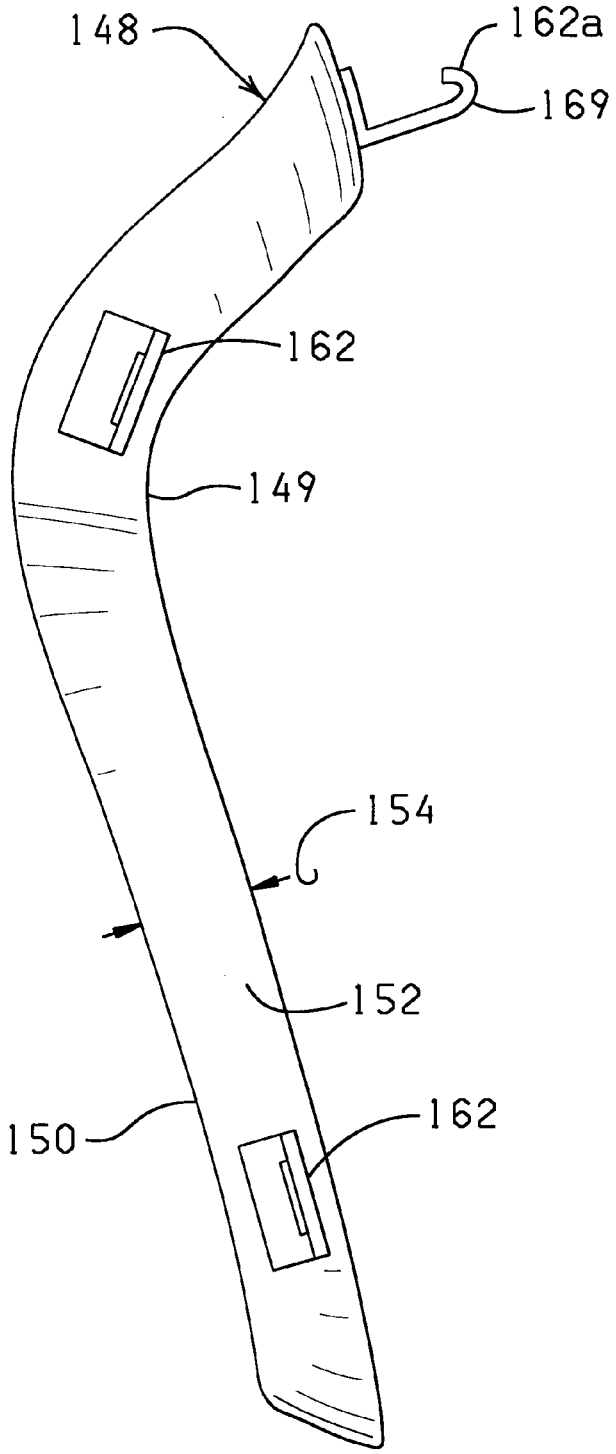
FIG. 18 is a side view of the hood support frame of FIG. 17.

As best shown in FIGS. 17 and 18, the support frame 148 is a substantially annular member which is preferably constructed of a strip of heat resistant material, such as a heat resistant plastic. The support frame 148 has a forward edge 149, a rearward edge 150, an inner side 151, an outer side 152, a thickness 153 extending from the outer side 152 to the inner side 151, and a width 154 extending from the forward edge 149 to the rearward edge 150. The support frame 148 is generally configured so that the forward edge 149 conforms to the contour of the groove 138 of the face mask 112. The thickness 153 of the support frame 148 is such that the support frame 148 is flexible in a generally radial inward direction as represented by lines 155*a* and 155*b*. This inward flexibility facilitates handling of the hood 113 during the attachment of the hood 113 to the face mask 112, as well as detachment of the hood 113 from the face mask 112. In contrast, the width 154 of the support frame 148 is such that the support frame 148 is substantially rigid across the width 154 to prevent the support frame 148 from buckling when operatively positioned in the groove 138 of the face mask 112 and thus prevent the formation of gaps between the annular edge 147 of the hood 113 and the face mask 112 during use.

Figure 19:
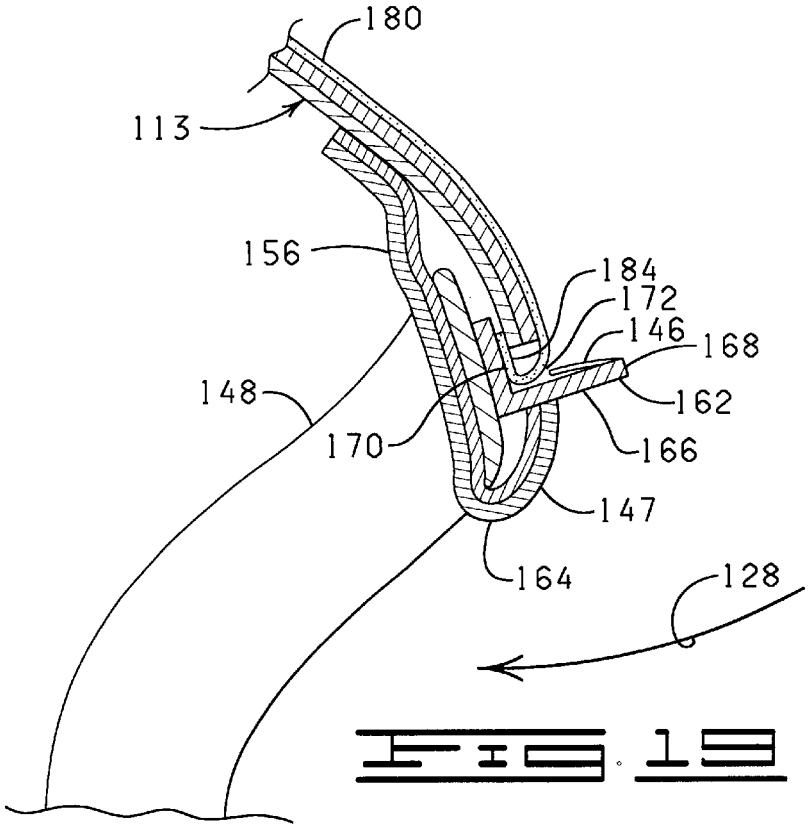
FIG. 19 is a cross-sectional view of the firefighting hood taken along line 19—19 of FIG. 13.

The support frame 148 is illustrated in FIG. 19 as being disposed in a hem 156 formed adjacent the annular edge 147 of the hood 113. To facilitate insertion and removal of the support frame 148 into and from the hem 156, the support frame 148 may be provided with a cut 158 (FIG. 17) whereby the support frame 148 can be threaded into the hem 156 through a slit 160 (FIG. 13) formed in the hood 113. Alternatively, the support frame 148 can be formed as a continuous ring, and the hem 156 formed about the support member 148. While the support frame 148 is shown to be disposed in the hem 156, it will be appreciated by those of ordinary skill in the art that the support frame 148 may be secured adjacent the annular edge 147 of the hood 113 in a variety of ways, including stitching, adhesives, or mechanical fasteners.

To attach the hood 113 to the face mask 112, the support frame 148 is provided with a plurality of connector members 162 and a connector member 162*a* which are circumferentially spaced about the support frame 148 and adapted to be matingly engaged with a corresponding connector member 164 (FIG. 13) of the rim 121. The connector members 162 illustrated in FIGS. 16–18 include a clip portion 166 (FIG. 19) sized to be lockingly received in a slot 168 of the connector member 164 of the rim 121 while the connector member 162*a* has a hook shaped portion 169 which is receivable in one of the slots 168. The connector members 162 and 162*a* are shaped to utilize the connector members 164 of the rim 121 without requiring modification of the rim 121 which is initially provided with the connector members 164 for receiving straps, such as the straps 14 illustrated in FIG. 1, for securing the face mask 112 snugly against a firefighter's face.

Figure 20:
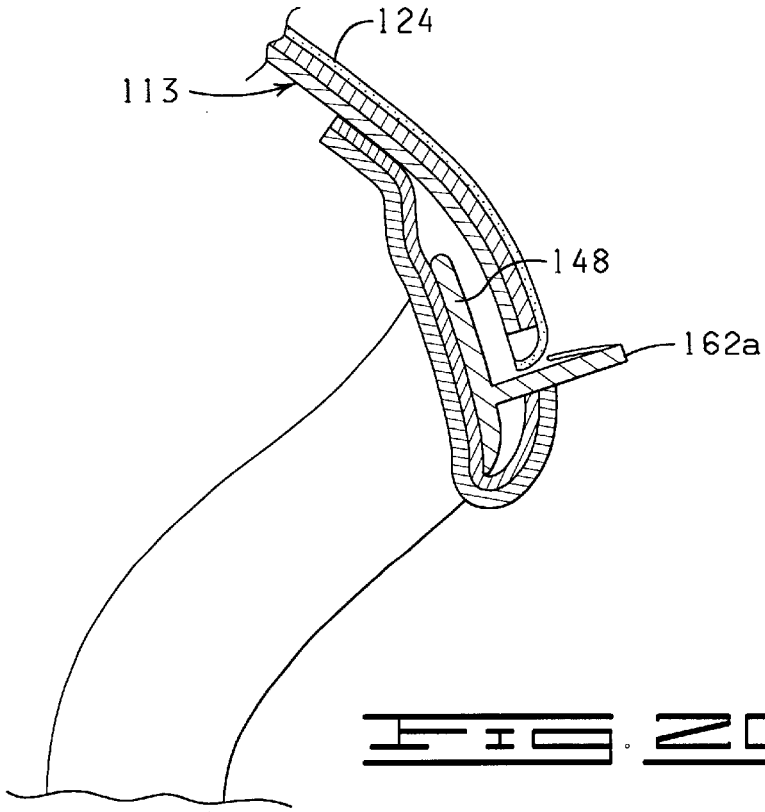
FIG. 20 is a cross-sectional view similar to FIG. 19 illustrating another embodiment of a hood support frame constructed in accordance with the present invention.

Referring to FIG. 19, the connector members 162 have a supporting leg 170 attached to the support frame 148 by conventional joining methods, such as bonding or stitching. The clip portion 166 extends from the supporting leg 170 and through an opening 172 (FIG. 19) provided in the firefighting hood 113. Alternatively, as illustrated in FIG. 20, the connector members 162 and 162*a* can be formed with the support frame 148 in a single piece construction.

Returning to FIGS. 12 and 13, the hood 113 further includes a harness 174 having a plurality of straps 176 for securing the face mask 112 snugly against a firefighter's face. The two lower straps 176 (only one being visible in FIGS. 12 and 13) have a buckle 178 for adjusting the tension of the harness 174. The harness 174 is incorporated into the hood 113 by connecting the distal end of the straps 176 to the support frame 148 preferably at a location corresponding to the location of the connector members 162 and 162*a*. The straps 176 may be attached to the support frame 148 by conventional joining methods, such as bonding or stitching. It will also be appreciated that the straps 176 can be disposed between multiple layers of the material of the firefighting hood 113 in a manner similar to that shown in FIG. 3.

Modifications can be made to the connector members 162 and 162*a* and to the connector members 164 of the rim 121 without deviating from the present invention. In addition, other types of fasteners can be used as well to attach the face mask 112 to the firefighting hood 113 in a similar manner as that described hereinabove, so long as the annular edge 147 of the hood 113 is nested behind the rim 121 of the face mask 112 in accordance with the present invention.

Figure 21:
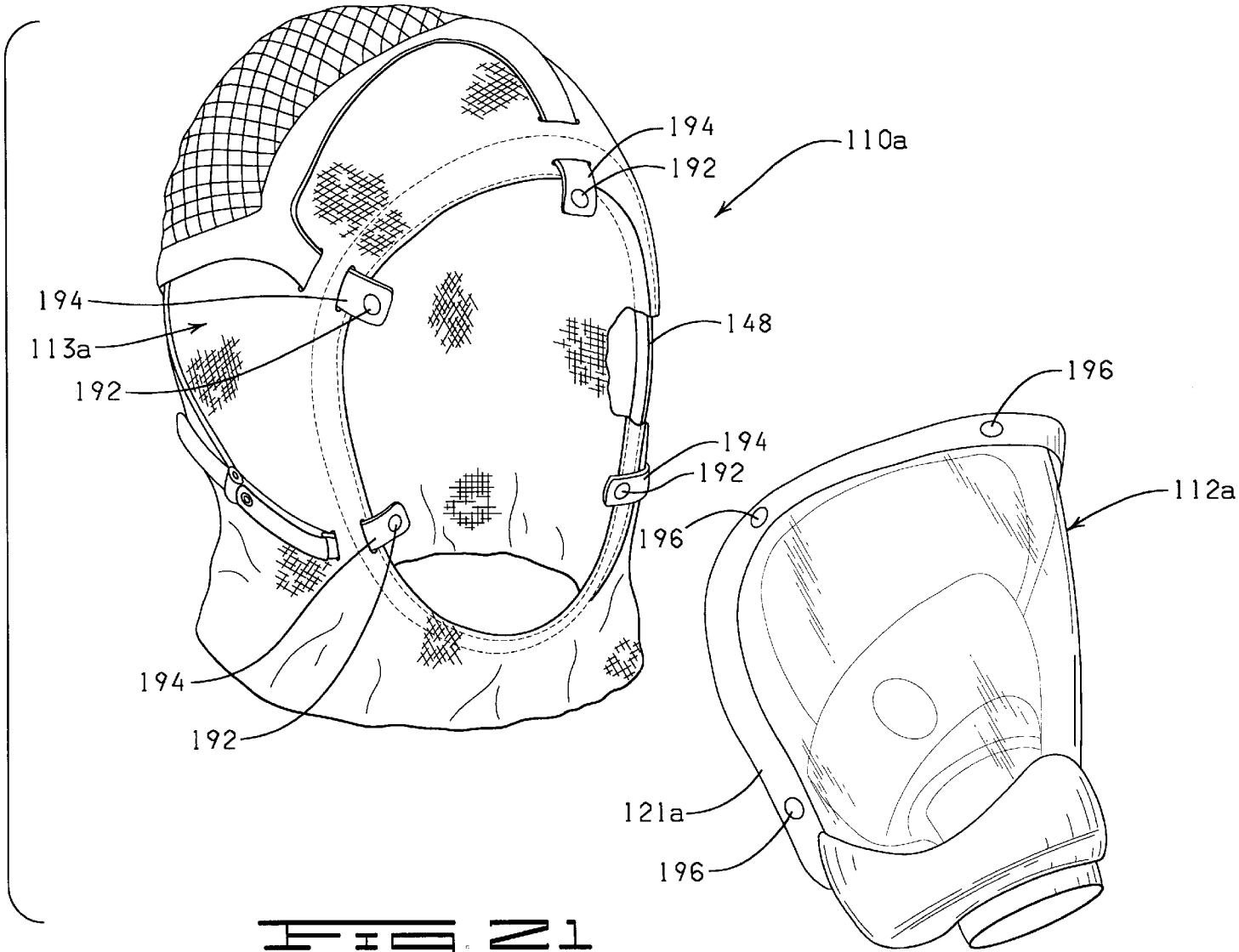
FIG. 21 is an exploded, perspective view of another embodiment of firefighting hood and face mask assembly constructed in accordance with the present invention.

FIG. 21, for example, illustrates a firefighting hood and face mask assembly 110*a* wherein snap fastening members are utilized to connect a face mask 112*a* to a firefighting hood 113*a*. The snap fastening members each include a female snap portion 192 supported on a strap member 194 that, in turn, depends from the support frame 148 in a manner similar to that of the connector members 162 above. Corresponding male snap portions 196 are supported on a rim 121*a* of the face mask 112*a* for joining with the female snap portions 192 when the firefighting hood 113*a* is operatively positioned so as to nest the frame 148 behind the rim 121*a*.

Figure 22:
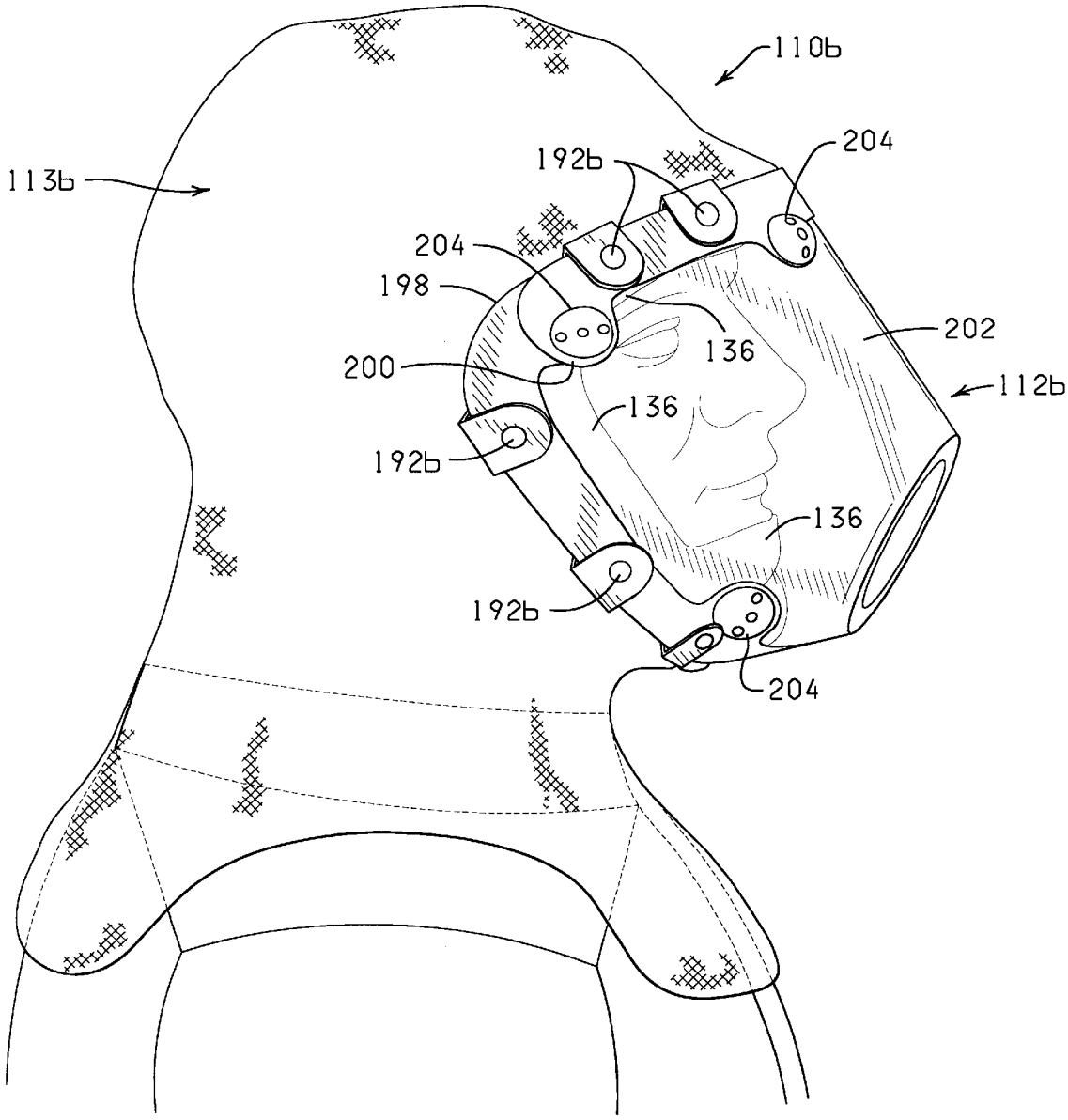
FIG. 22 is a side elevational view of another embodiment of a firefighting hood and face mask assembly constructed in accordance with the present invention.

FIG. 22 illustrates another firefighting hood and face mask assembly 110*b* constructed in accordance with the present invention wherein the male snap portions (not shown) are supported by a support member 198 that is attached to a face mask 112*b* in a retrofit application of the present invention to a prior art face mask 112*b*. The support member 198 has a frame 200 that is disposable on the outside of a face plate 202 of the prior art face mask 112*b*, and aligns with a number of attaching buttons 204 that are commonly provided in many commercially available prior art face masks 112*b*. The frame 200 is further provided with a plurality of snap members (not shown) which are adapted to receive a corresponding female snap member 192*b* which depends from the support frame 148 in a manner similar to that described hereinabove for the connector members 162.

It should be apparent to one of ordinary skill in the art that it is within the scope of the present invention to utilize any one of, or a combination of, the above or similar fastening systems for attaching the face mask 112 to the firefighting hood 113, such as tabs, snap fasteners, buttons, hood and loop, and the like.

To don the firefighting hood and face mask assembly 110 of the present invention, the firefighter first removes his helmet (not shown), and then merely slips the firefighting hood and face mask assembly 110 over his head. That is, the face mask 112 can be attached to the firefighting hood 113 before donning them. The firefighter can then re-don his firefighting helmet without disrupting the operative relationship of the firefighting hood 113 to the face mask 112, unlike the prior art devices.

The present invention thus provides a protective headgear for a firefighter which satisfies the performance requirements of a face mask and a firefighting hood, yet which is much quicker to don than conventional systems, and which is safer than conventional systems.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A protective hood for use with a face mask for protecting an individual from elements associated with a firefighting site, the face mask having an annular rim having a front side, a rear side, an inner side, and an outer side, a seal member secured to the rim and adapted for sealing engagement with the individual's face, the seal member configured so as to define an annular recess between a portion of the seal member and the rear side of the rim, and a face plate extending across the rim and cooperating with the rim and the seal member to form a breathing chamber when the seal member is in sealing engagement with the individual's face, the hood comprising:

a head covering portion constructed of a fire resistant material and configured to be extendible over the head of the individual, the head covering portion having a face opening for exposing the individual's face to the breathing chamber of the face mask, the face opening defined by an annular edge;

a support frame secured adjacent the annular edge of the head covering portionto increase the rigidity of the annular edge of the head covering portion, the annular edge of the head covering portion and the frame member disposable in the annular recess of the face mask; and means for detachably connecting the head covering portion to the face mask so as to secure the annular edge of the head covering portion in the annular recess of the face mask and thereby prevent direct exposure of the individual's head to the high heat environment associated with a firefighting site.

2. The hood of claim 1 wherein the head covering portion further comprises:

at least one strap having a first end attached to the head covering portion near one portion of the connecting means and a second end attached to the head covering portion near a second portion of the connecting means, the strap extending around a portion of the head covering portion for holding the face mask snugly against the individual's face.

3. The hood of claim 2 wherein each of the first and second ends of the strap are connected to the support frame.

4. The hood of claim 1 wherein the support frame has a forward edge configured to conform to the contour of the recess of the face mask.

5. The hood of claim 1 wherein the support frame has a thickness such that the support frame is flexible in a radial inward direction and a width such that the support frame is substantially rigid across the width to prevent the support frame from buckling when operatively positioned in the recess of the face mask and thus prevent the formation of gaps between the annular edge of the head covering portion and the face mask.

6. The hood of claim 1 wherein the support frame is disposed within a hem formed in the head covering portion.

7. The hood of claim 1 wherein at least a portion of the connecting means is secured to the support frame.

8. A protective firefighting hood for use with a face mask for protecting an individual from elements associated with a firefighting site, the face mask having annular rim, a seal member secured to the rim and adapted for sealing engagement with the individual's face, and a face plate extending across the rim and cooperating with the rim and the seal member to form a breathing chamber when the seal member is in sealing engagement with the individual's face, the hood comprising:

a head covering portion constructed of a flexible fire resistant material and configured to be extendible over the head of the individual, the head covering portion having a face opening for exposing the individual's face to a breathing chamber of the face mask, the face opening defined by an annular edge; and a support frame secured to the head covering portion adjacent to the annular edge thereof to increase the rigidity of the annular edge of the head covering portion, the annular edge of the head covering portion and the support frame disposable between the seal member and the annular rim of the face mask, wherein the head covering portion is detachably connectable to the face mask to secure the annular edge of the head covering portion between the seal member and the annular rim and thereby prevent direct exposure of the individual's head to the high heat environment associated with a firefighting site at a location between the annular edge of the head covering portion and the face mask.

9. The hood of claim 8 wherein the support frame has a forward edge configured to conform to the contour of the face mask.

10. The hood of claim 8 wherein the support frame has a thickness such that the support frame is flexible in a radial inward direction and a width such that the support frame is substantially rigid across the width to prevent the support frame from buckling when operatively positioned in the between the seal member and the annular rim and thus prevent the formation of gaps between the annular edge of the head covering portion and the face mask.

11. The hood of claim 8 wherein the support frame is disposed within a hem formed in the head covering portion.

12. The hood of claim 11 wherein the support frame is removable from the head covering portion.

13. A protective firefighting hood for use with a face mask for protecting an individual from elements associated with a firefighting site, the face mask having annular rim, a seal member secured to the rim and adapted for sealing engagement with the individual's face, a face plate extending across the rim and cooperating with the rim and the seal member to form a breathing chamber when the seal member is in sealing engagement with the individual's face, and a plurality of connector members, the hood comprising:

a head covering portion constructed of a flexible fire resistant material and configured to be extendible over the head of the individual, the head covering portion having a face opening for exposing the individual's face to a breathing chamber of the face mask, the face opening defined by an annular edge; and a support frame secured to the head covering portion adjacent to the annular edge thereof to increase the rigidity of the annular edge of the head covering portion, the annular edge of the head covering portion and the support frame disposable between the seal member of the face mask and the annular rim thereof, the support frame having a plurality of connector members matingly engageable with the connector members of the face mask to secure the annular edge of the head covering portion between the seal member and the annular rim and thereby prevent direct exposure of the individual's head to the high heat environment associated with a firefighting site at a location between the annular edge of the head covering portion and the face mask.

14. The hood of claim 13 wherein the support frame has a forward edge configured to conform to the contour of the face mask.

15. The hood of claim 13 wherein the support frame has a thickness such that the support frame is flexible in a radial inward direction and a width such that the support frame is substantially rigid across the width to prevent the support frame from buckling when operatively positioned in the between the seal member and the annular rim and thus prevent the formation of gaps between the annular edge of the head covering portion and the face mask.

16. The hood of claim 13 wherein the support frame is disposed within a hem formed in the head covering portion.

17. The hood of claim 16 wherein the support frame is removable from the head covering portion.

* * * * *